US010196703B2

(12) United States Patent
Kim et al.

(10) Patent No.: US 10,196,703 B2
(45) Date of Patent: Feb. 5, 2019

(54) HOT-ROLLED STEEL HAVING EXCELLENT WORKABILITY AND ANTI-AGING PROPERTIES

(71) Applicant: POSCO, Pohang-si, Gyeongsangbuk-do (KR)

(72) Inventors: Jai-Ik Kim, Pohang-si (KR); Jong-Hwa Kim, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 254 days.

(21) Appl. No.: 14/902,322

(22) PCT Filed: Dec. 24, 2013

(86) PCT No.: PCT/KR2013/012086
§ 371 (c)(1),
(2) Date: Dec. 30, 2015

(87) PCT Pub. No.: WO2015/002363
PCT Pub. Date: Jan. 8, 2015

(65) Prior Publication Data

US 2016/0153064 A1 Jun. 2, 2016

(30) Foreign Application Priority Data

Jul. 20, 2013 (KR) ..... 10-2013-0077898
Sep. 20, 2013 (KR) ..... 10-2013-0116700

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/32*** | (2006.01) |
| ***C22C 38/00*** | (2006.01) |
| ***C21D 9/46*** | (2006.01) |
| ***C22C 38/54*** | (2006.01) |
| ***C21D 8/04*** | (2006.01) |
| ***C21D 6/00*** | (2006.01) |
| ***C21D 7/06*** | (2006.01) |
| ***C21D 8/02*** | (2006.01) |

(52) U.S. Cl.

CPC ..... *C21D 9/46* (2013.01); *C21D 6/005* (2013.01); *C21D 6/008* (2013.01); *C21D 7/06* (2013.01); *C21D 8/0205* (2013.01); *C21D 8/0226* (2013.01); *C21D 8/0263* (2013.01); *C21D 8/0426* (2013.01); *C21D 8/0463* (2013.01); *C21D 8/0473* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/54* (2013.01); *C21D 2211/001* (2013.01); *C21D 2211/005* (2013.01)

(58) Field of Classification Search
None
See application file for complete search history.

(56) References Cited

U.S. PATENT DOCUMENTS 4,410,372 A 10/1983 Takahashi et al.

FOREIGN PATENT DOCUMENTS

| | | | |
|---|---|---|---|
| CN | 100374586 | C | 3/2008 |
| CN | 101775540 | A | 7/2010 |
| CN | 102712974 | A | 10/2012 |
| EP | 1 195 447 | A1 | 4/2002 |
| EP | 1 327 695 | A1 | 7/2003 |
| JP | 58-161722 | A | 9/1983 |
| JP | 60-197845 | A | 10/1985 |
| JP | 61-003844 | A | 1/1986 |
| JP | 63-143225 | A | 6/1988 |
| JP | 2-141529 | A | 5/1990 |
| JP | 6-70255 | B2 | 9/1994 |
| JP | 08-109436 | | 4/1996 |
| JP | 9-227950 | A | 9/1997 |
| JP | 10-195543 | A | 7/1998 |
| JP | 2001-089815 | A | 4/2001 |
| JP | 2001-316764 | A | 11/2001 |
| JP | 2005-120453 | A | 5/2005 |
| JP | 3793253 | B2 | 7/2006 |
| JP | 2007-239035 | A | 9/2007 |
| JP | 2008-189958 | A | 8/2008 |
| KR | 10-2010-0035826 | A | 4/2010 |
| KR | 10-2012-0051388 | A | 5/2012 |
| WO | 2013/081224 | A1 | 6/2013 |

OTHER PUBLICATIONS

International Search Report issued in International Application No. PCT/KR2013/012086, dated Apr. 7, 2014, with English Translation.
European Search Report issued in European Application No. 13888735.1 dated Jun. 21, 2016.
Chinese Office Action issued in Chinese Application No. 201380078026.1 dated Aug. 2, 2016.
Office Action issued in corresponding Japanese Application No. 2016-523616 dated Jan. 31, 2017.

*Primary Examiner* — Deborah Yee
(74) *Attorney, Agent, or Firm* — McDermott Will & Emery LLP

(57) ABSTRACT

The present invention relates to a hot-rolled steel sheet applied as a material for home appliances, vehicles, or the like and, more specifically, to a hot-rolled steel sheet having excellent workability and anti-aging properties and a method for manufacturing the same. To this end, the present invention uses ultra-low carbon Al-killed steel so as to optimize the alloying elements thereof and the manufacturing conditions, thereby providing hot-rolled steel sheets having both excellent workability and anti-aging properties.

7 Claims, No Drawings

HOT-ROLLED STEEL HAVING EXCELLENT WORKABILITY AND ANTI-AGING PROPERTIES

RELATED APPLICATIONS

This application is the U.S. National Phase under 35 U.S.C. § 371 of International Application No. PCT/KR2013/012086, filed on Dec. 24, 2013, which in turn claims the benefit of Korean Application No. 10-2013-0077898, filed on Jul. 3, 2013, and Korean Application No. 10-2013-0116700, filed on Sep. 30, 2013, the disclosures of which Applications are incorporated by reference herein.

TECHNICAL FIELD

The present disclosure relates to a hot-rolled steel sheet having excellent workability and anti-aging properties and a method for manufacturing the hot-rolled steel sheet.

BACKGROUND ART

Steels used in applications such as the manufacturing of home appliances and automobiles are required to have properties such as corrosion resistance, anti-aging properties, and formability.

The term "formability" is used herein to denote the ability of a material to undergo deformation into a desired shape without fracturing, tearing-off, necking, or shape errors such as wrinkling, spring-back, or galling occurring. In engineering, formability may be classified according to deformation modes. Examples of deformation modes include four machining modes: drawing, stretching, bending, and stretch-flanging.

Among the machining modes, stretching is simple, compared to deep-drawing, because a raw material almost never moves along an interface between the raw material and a die during stretching. In addition, stretching is known as a machining mode closely related to the elongation properties (elongation) of a material and is little affected by die conditions, unlike drawing, which is significantly affected by die conditions.

In a drawing-die process related to deep drawability, a material (plate) is placed on a drawing die and pressed using a blank holder, and then a punch is pushed into a recess of the drawing die to deform the plate. Therefore, the diameter of the plate is reduced after the drawing-die process. It is known that drawing is significantly related to the Lankford value (r-value), the ratio of strain in the thickness direction of a material to strain in the width direction of the material.

Particularly, the average plastic strain ratio (r-bar value) expressed by Formula 1 below and the plastic anisotropy (Δr value) expressed by Formula 2 below, obtained from r-values measured in different directions with respect to a rolling direction, are representative material properties describing drawability.

$$r\text{-bar}=(r_0+r_{90}+2r_{45})/4 \quad (1)$$

$$\Delta r=(r_0+r_{90}-2r_{45})/2 \quad (2)$$

where $r_i$ refers to the r-value of a specimen taken at an angle of i° from the direction of rolling.

As the r-bar of a material expressed by Formula 1 increases, the depth of a cup to be formed using the material may be increased, and thus it is considered that a high r-value guarantees a high degree of deep drawability.

In addition, planar anisotropy, an important quality property in a cup forming process, refers to the extent that the physical/mechanical properties of a material are dependent on direction. Planar anisotropy is basically caused by the strong directivity of each grain undergoing deformation such as plastic deformation. If grains are randomly distributed in a forming process, the grains may not have directivity, and thus the planar anisotropy of the grains may be low.

In general, however, grains in steel sheets have high directivity and thus exhibit plastic anisotropic behavior during a forming process. In a cup forming process, high planar anisotropy increases the occurrence of earing, which leads to height variations of formed portions of cups, thereby increasing defective products and material loss. If the Δr value, being an index of planar anisotropy, is close to 0, strain is uniform in all directions, and thus isotropic properties are present. Therefore, it is necessary to properly maintain the Δr value during a drawing process.

In the related art, as a method of guaranteeing the anti-aging properties and workability of steel, medium-low carbon Al-killed steel may be subjected to a hot-rolling process and a cold-rolling process, and then to a batch annealing process so as to efficiently adjust the contents of carbon and nitrogen dissolved in the steel.

However, the method requires a relatively long heat treatment time, resulting in low productivity. In addition, due to non-uniform heating and cooling patterns, material property variations increase in coils of steel sheets.

Therefore, according to a method proposed to remove the above-mentioned problems from ultra low carbon steel used as a material for a forming process and having anti-aging properties through a continuous annealing process, carbonitride forming elements such as titanium (Ti) or niobium (Nb) are added to the ultra low carbon steel so as to precipitate solute elements and obtain intended properties.

However, this method increases material costs and lowers the surface properties of steel due to the addition of relatively expensive elements. Furthermore, although such elements are added during a steel making process, it may be difficult to ensure workability such as cupping properties, due to the formation of disordered texture in a hot-rolling process.

Therefore, for example, hot-rolled steel sheets are used as a material for a forming process after a cold-rolling process and an annealing process are performed on the hot-rolled steel sheets to form an intended recrystallized texture in the steel sheets. In this case, however, material costs are also high because of the addition of alloying elements, and processing costs may be high because additional processes are necessary.

Therefore, there has been increasing interest in techniques for guaranteeing properties of hot-rolled steel sheets used as a material for a forming process, and in manufacturing methods using the hot-rolled steel sheets, so as to decrease manufacturing costs and the number of processes.

Related Patent Document 1 discloses a method of manufacturing a very thin hot-rolled steel sheet for a forming process using an endless processing technique by adding small amounts of manganese (Mn) and boron (B) to 0.01% to 0.08% carbon steel to decrease the Ar3 transformation point of the steel, reheating the steel to 1150° C., and performing a primarily coiling process at a temperature equal to or higher than the Ar3 transformation point, a joining process, and a final coiling process at a temperature of 500° C. or higher. According to the disclosed method, although the stretchability of the hot-rolled steel sheet is guaranteed because the hot-rolled steel sheet has an elongation of 45% or greater, the drawability of the hot-rolled steel sheet is not improved.

In addition, Patent Document 2 discloses a technique for ensuring drawability through the effect of self-annealing. According to the disclosed technique, ultra low carbon steel containing titanium (Ti) and/or niobium (Nb) is subjected to an endless hot-rolling process including a finish hot-rolling process in a ferrite single phase region, and the process temperature difference between the finish hot-rolling process and a coiling process is maintained to be 100° C. or less. However, according to the disclosed technique, relatively expensive alloying elements such as niobium (Nb) may be added to fix elements dissolved in steel, and it may be difficult to stably produce products because it is necessary to strictly manage the temperature of the finish hot-rolling process and the temperature of the coiling process for guaranteeing the formation of recrystallized grains.

(Patent Document 1) Japanese Patent Application Laid-open Publication No. H9-227950

(Patent Document 2) Japanese Patent Application Laid-open Publication No. H2-141529

DISCLOSURE

Technical Problem

An aspect of the present disclosure may provide a high-strength hot-rolled steel sheet for manufacturing home appliance components or automobile components through a drawing process. In detail, the hot-rolled steel sheet is manufactured using ultra low carbon Al-killed steel not including carbonitride forming elements such as titanium (Ti) or niobium (Nb) while properly controlling the contents of alloying elements, the content ratio of the alloying elements, and manufacturing conditions, so as to improve anti-aging properties and formability of the hot-rolled steel sheet. In addition, another aspect of the present disclosure may provide a method of manufacturing the hot-rolled steel sheet.

Technical Solution

According to an aspect of the present disclosure, a hot-rolled steel sheet having a high degree of workability and anti-aging properties may include, by wt %, carbon (C): 0.0001% to 0.003%, manganese (Mn): 0.07% to 0.8%, silicon (Si): 0.03% or less (excluding 0%), aluminum (Al): 0.03% to 0.08%, boron (B): 0.0005% to 0.002%, nitrogen (N): 0.0005% to 0.002%, phosphorus (P): 0.05% or less, sulfur (S): 0.001% to 0.015%, and the balance of iron (Fe) and inevitable impurities, wherein the hot-rolled steel sheet may have a gamma (γ)-fiber/alpha (α)-fiber texture pole intensity ratio of 4 to 14.

According to another aspect of the present disclosure, a method for manufacturing a hot-rolled steel sheet having a high degree of workability and anti-aging properties may include: reheating a steel slab to a temperature of 1100° C. to 1200° C., the steel slab including, by wt %, C: 0.0001% to 0.003%, Mn: 0.07% to 0.8%, Si: 0.03% or less (excluding 0%), Al: 0.03% to 0.08%, B: 0.0005% to 0.002%, N: 0.0005% to 0.002% P: 0.05% or less, S: 0.001% to 0.015%, and the balance of Fe and inevitable impurities; finish hot-rolling the steel slab within a temperature range of 600° C. or higher (Ar3—50° C.) so as to form a hot-rolled steel sheet; coiling the hot-rolled steel sheet; and descaling the coiled hot-rolled steel sheet, wherein in the finish hot-rolling of the steel slab, a coefficient of friction between the steel slab and rolling rolls may be within a range of 0.05 to 0.2, and a Rf/Rt ratio may be within a range of 0.2 to 0.3 where Rt refers to a total reduction ratio of all stands, and Rf refers to a reduction ratio of last two passes.

The above-described aspects of the present disclosure do not include all aspects or features of the present disclosure. Other aspects or features, and effects of the present disclosure will be clearly understood from the following descriptions of exemplary embodiments.

Advantageous Effects

According to the present disclosure, the alloying elements and manufacturing conditions of the hot-rolled steel sheet are optimized, and thus the stretchability, drawability, and anti-aging properties of the hot-rolled steel sheet are satisfactory. Thus, the hot-rolled steel sheet may be usefully used as a material for a forming process.

Particularly, the hot-rolled steel sheet of the present disclosure may be used instead of existing cold-rolled steel sheets.

BEST MODE

The inventors have conducted research into developing hot-rolled steel sheets having anti-aging properties in addition to having drawability like that of existing cold-rolled steel sheets so as to substitute cold-rolled steel sheets with hot-rolled steel sheets. As a result, the inventors have found that if the contents of alloying elements and manufacturing processes, particularly a rolling process, are properly controlled, hot-rolled steel sheets having high drawability and anti-aging properties can be manufactured without additionally performing subsequent heat treatment processes. Based on this knowledge, the inventors have invented the present invention.

Hereinafter, a hot-rolled steel sheet for a forming process and a method for manufacturing the hot-rolled steel sheet will be described in detail with reference to exemplary embodiments of the present disclosure. However, the scope of the present invention is not limited thereto. It will be apparent to those skilled in the art that modifications and variations could be made without departing from the scope of the present invention.

Exemplary embodiments of the present disclosure will now be described in detail.

According to an exemplary embodiment of the present disclosure, a hot-rolled steel sheet includes, by wt %, C: 0.0001% to 0.003%, Mn: 0.07% to 0.8%, Si: 0.03% or less (excluding 0%), Al: 0.03% to 0.08%, B: 0.0005% to 0.002%, N: 0.0005% to 0.002%, P: 0.05% or less, S: 0.001% to 0.015%, and the balance of Fe and inevitable impurities, wherein the hot-rolled steel sheet has a gamma (γ)-fiber/alpha (α)-fiber texture pole intensity ratio of 4 to 14.

Hereinafter, reasons for regulating the contents of alloying elements of the hot-rolled steel sheet as described above will be described according to the exemplary embodiment of the present disclosure. In the following description, the content of each component is given in wt % unless otherwise specified.

Carbon (C): 0.0001% to 0.003%

Although carbon (C) is added to improve the strength of the steel sheet, carbon (C) dissolved in steel is a representative element causing aging. If the content of carbon (C) is greater than 0.003%, since the amount of carbon (C) dissolved in the steel sheet is increased, it may be difficult to obtain intended material properties after the hot-rolled steel sheet is finally manufactured. In addition, the aging properties of the steel sheet may be negatively affected, and the drawability of the steel sheet may be significantly decreased. On the other hand, if the content of carbon (C) is less than 0.0001%, since it is necessary to severely control the content of carbon (C) during a steel making process, the price of alloy iron may markedly increase, and the steel making process may not be easily performed. Therefore, it may be preferable that the content of carbon (C) be adjusted within the range of 0.0001% to 0.003%, so as to stably obtain workability and anti-aging properties of the steel sheet as intended in the exemplary embodiment of the present disclosure.

Manganese (Mn): 0.07% to 0.8%

Manganese (Mn) prevents red shortness that may be caused by sulfur (S) and guarantees an intended degree of strength. To this end, the content of manganese (Mn) may preferably be 0.07% or greater. However, if the content of manganese (Mn) is greater than 0.8%, due to the remaining amount of manganese (Mn) dissolved in the steel sheet, the drawability of the steel sheet may decrease, and micro-segregation may occur to decrease the formability of the steel sheet. Therefore, according to the exemplary embodiment of the present disclosure, it may be preferable that the content of manganese (Mn) be within the range of 0.07% to 0.8%.

Silicon (Si): 0.03% or Less (Excluding 0%)

Silicon (Si) combines with oxygen (O) and forms an oxide layer on the surface of the steel sheet, thereby degrading the platability and surface quality of the steel sheet. Therefore, the content of silicon (Si) is maintained at as low of a level as possible. However, the upper limit of the content of silicon (Si) is set to be 0.03% in consideration of a steel making process.

Al: 0.03% to 0.08%

Aluminum (Al) is an element added to Al-killed steel in order to remove oxygen and prevent material properties deterioration caused by aging. When the content of aluminum (Al) is 0.03% or greater, the above-described effects may be obtained. However, if the content of Aluminum (Al) is excessively high, the deoxidizing effect may be saturated, and surface inclusions such as aluminum oxide ($Al_2O_3$) may increase to cause deterioration of the surface properties of the hot-rolled steel sheet. Therefore, it may be preferable that the upper limit of the content of aluminum (Al) be 0.08%.

Boron (B): 0.0005% to 0.002%

Boron (B) combines with elements dissolved in steel and forms boron-containing precipitates, thereby improving workability and anti-aging properties. In addition, boron-containing precipitates suppress the growth of steel grains even in high-temperature conditions, thereby promoting the formation of fine ferrite particles. It may be preferable that the content of boron (B) be 0.0005% or greater to obtain the above-described effects. However, if the content of boron (B) is excessively high, the workability of the steel sheet may be reversed and decrease. Therefore, it may be preferable that the upper limit of the content of boron (B) be 0.002%.

Nitrogen (N): 0.0005% to 0.0020%

Nitrogen (N) is a representative example of interstitial enhancement elements that can be introduced into steel for enhancing the steel. Nitrogen (N) imparts intended strength properties to the steel sheet. To this end, it may be preferable that the content of nitrogen (N) be 0.0005% or greater. However, if the content of nitrogen (N) is excessively high, the anti-aging properties of the steel sheet may be markedly degraded, and a steel making process may not be easily performed because of the burden of denitrification. Therefore, it may be preferable that the upper limit of the content of nitrogen (N) be 0.0020%.

Phosphorus (P): 0.05% or Less

In steel, phosphorus (P) remains as a solute element and induces solid-solution strengthening, thereby improving the strength and hardness of the steel. However, if the content of phosphorus (P) in steel is greater than 0.05%, center segregation occurs during a casting process, and the workability of the steel decreases. Therefore, according to the exemplary embodiment of the present disclosure, it may be preferable that the content of phosphorus (P) be 0.05% or less.

Sulfur (S): 0.001% to 0.015%

In steel, sulfur (S) combines with manganese (Mn) and forms a non-metallic inclusion acting as a corrosion initiator. In addition, sulfur (S) causes red shortness. Therefore, the content of sulfur (S) is adjusted to be as low as possible. However, the lower limit of the content of sulfur (S) is set to be 0.001% in consideration of a steel making process. If the content of sulfur (S) in steel is excessively high, some of the sulfur (S) combines with manganese (Mn), and coarse manganese sulfite precipitate is formed. Therefore, the upper limit of the content of sulfur (S) is set to be 0.015%.

In the exemplary embodiment of the present disclosure, the other component of the hot-rolled steel sheet is iron (Fe). However, impurities of raw materials or steel manufacturing environments may be inevitably included in the hot-rolled steel sheet, and such impurities may not be removed from the hot-rolled steel sheet. Such impurities are well-known to those of ordinary skill in the steel manufacturing industry, and thus descriptions thereof will not be given in the present disclosure.

In steel having the above-described composition, the content ratio of elements that combine with other elements and form precipitates of carbides and nitrides may be controlled so as to guarantee the anti-aging properties and drawability of the steel, improve the properties of the steel, and obtain intended properties.

In the hot-rolled steel sheet having the above-described composition according to the exemplary embodiment of the present disclosure, aluminum (Al), an alloying element causing the formation of nitrides, may have a relationship with boron (B) and nitrogen (N) as expressed by Formula 1 below, so as to guarantee the anti-aging properties and drawability of the hot-rolled steel sheet.

$$0.025 \leq (Al \times B)/N \leq 0.07 \quad \text{[Formula 1]}$$

where Al, B, and N are in wt %.

In the exemplary embodiment, if (Al×B)/N is less than 0.025, the amount of nitrogen (N) dissolved in a sheet is relatively high, and thus the anti-aging properties and workability of a final product may be degraded. On the other hand, if the (Al×B)/N is greater than 0.07, anti-aging properties are guaranteed. However, the recrystallization temperature of the hot-rolled steel sheet increases, and manufacturing costs increase because of large amounts of expensive alloying elements. Therefore, in the exemplary embodiment of the present disclosure, it may be preferable that the content ratio of (Al×B)/N be adjusted within the range of 0.025 to 0.07.

Furthermore, in the exemplary embodiment of the present disclosure, carbon (C) added to steel exists in the form of carbide precipitates such as cementite, or remains as solute carbon in a ferrite matrix. Solute carbon in the ferrite matrix causes aging, that is, varies the properties of the steel over time. Therefore, the amount of solute carbon is adjusted by a method such as a cooling method or a precipitating method.

In the exemplary embodiment of the present disclosure, it may be preferable that the content of solute carbon in the hot-rolled steel sheet be adjusted to be 5 ppm or less. If the content of solute carbon is greater than 5 ppm, the anti-aging properties of the steel sheet may deteriorate, and thus it may be difficult to guarantee the workability of the steel sheet.

In the exemplary embodiment of the present disclosure, the pole intensity ratio of texture fibers relating to the formability of steel may be adjusted to obtain an intended degree of drawability.

Generally, texture refers to the arrangement of crystallographic planes and orientations, and a band of texture developed in a certain direction is known as a texture fiber. A group of texture components having an orientation normal to a (111) plane is known as a gamma (γ)-fiber, and a group of texture components having planes parallel to a <110> direction is known as an alpha (α)-fiber.

The above-described texture that indicates aggregation properties of grains has a close relationship with drawability. It is known that drawability improves as the pole intensity of the γ-fiber texture normal to the (111) plane increases. In the present disclosure, however, it is shown that drawability significantly relates to the relationship between the pole intensity of the γ-fiber texture and the pole intensity of the α-fiber texture parallel to the <110> direction, and this relation is controlled using indexes for guaranteeing drawability.

In detail, according to the exemplary embodiment of the present disclosure, the γ-fiber/α-fiber texture pole intensity ratio of the hot-rolled steel sheet may be adjusted within the range of about 4 to about 14 so as to impart a proper degree of drawability to the hot-rolled steel sheet.

If the γ-fiber/α-fiber texture pole intensity ratio is less than 4, the formation of texture on the (111) plane which improves drawability is insufficient, and thus an intended degree of drawability may not be obtained. On the other hand, if the γ-fiber/α-fiber texture pole intensity ratio is greater than 14, although formability improves, anisotropy increases and thus the occurrence of an earing phenomena increases resulting in material loss.

In this case, the γ-fiber texture may include at least one of (111)<121>, (111)<112>, and (554)<225> components, and the α-fiber texture may include at least one of (001)<110>, (112)<110>, and (225)<110> components.

According to the exemplary embodiment of the present disclosure, it may be preferable that the microstructure of the hot-rolled steel sheet include ferrite in an area fraction of 90% or greater. If the area fraction of ferrite is less than 90%, the workability of the hot-rolled steel sheet may be significantly decreased because of a high density of dislocations, and thus cracks may be formed during a drawing process.

According to the exemplary embodiment of the present disclosure, the hot-rolled steel sheet may further include cementite in addition to ferrite.

According to the exemplary embodiment of the present disclosure, the hot-rolled steel sheet may have an average plastic strain ratio (r-bar value) of 1.3 or greater, a plastic anisotropy (Δr value) of 0.15 or less, an elongation of 40% or greater, and an aging index of 2 $kgf/mm^2$ or less. That is, the hot-rolled steel sheet has a high degree of workability and anti-aging properties.

In addition, preferably, the hot-rolled steel sheet of the exemplary embodiment may have a thickness of 0.8 mm to 2.4 mm so as to be used as an ultrathin steel sheet.

Hereinafter, a method for manufacturing a hot-rolled steel sheet will be described in detail according to an exemplary embodiment of the present disclosure.

According to the exemplary embodiment of the present disclosure, a hot-rolled steel sheet may be formed of steel (steel slab) having the above-described alloying element contents through a reheating process, a hot-rolling process, a coiling process, and a descaling process. These processes will now be described in detail.

Reheating Process

An Al-killed steel slab having the above-described composition may be reheated. This reheating process is performed to smoothly perform the following hot-rolling process and obtain intended properties. The temperature range of the reheating process may be properly adjusted to obtain these effects.

In the exemplary embodiment of the present disclosure, the steel slab may be reheated in an austenite single phase range so as to make initial austenite coarse. For example, it may be preferable that the steel slab be heated within the temperature range of 1100° C. to 1200° C. If the reheating temperature is lower than 1100° C., the precipitation of aluminum nitride (AlN) may be suppressed. On the other hand, if the reheating temperature is higher than 1200° C., it may take an excessive amount of time for the steel slab to pass between hot-rolling rolls, and thus grains of the steel slab may grow abnormally. In this case, the workability of the steel slab may decrease, and the amount of surface scale causing the formation of surface defects may increase.

Hot-rolling Process

The reheated steel slab may be subjected to a finish hot-rolling process to form a hot-rolled steel sheet.

Preferably, the finish hot-rolling process may be performed in a ferrite single phase region at a temperature of 600° C. or higher (Ar3 transformation point—50° C.). That is, the finish hot-rolling process may be performed within a low ferrite temperature range.

As described above, if the finish hot-rolling process is performed within a ferrite temperature range, a microstructure recrystallized in a ferrite region may be obtained in a subsequent cooling process.

More preferably, the finish hot-rolling process may be performed within the temperature range of 600° C. to 800° C. If the finish hot-rolling process is performed at a temperature lower than 600° C., although workability may improve, it may be difficult to obtain a proper coiling temperature in a later coiling process, thereby increasing the burden of hot-rolling and significantly decreasing process continuity. On the other hand, if the finish hot-rolling process is performed at a temperature higher than 800° C., the fraction of deformed ferrite decreases during the finish hot-rolling process, and thus driving force for recrystallization may decrease. As a result, the workability of the hot-rolled steel sheet may not be guaranteed.

Particularly, according to the exemplary embodiment of the present disclosure, when the finish hot-rolling process is performed, the microstructure of the steel slab may include deformed ferrite, transformed ferrite, and austenite at the entrance of the finish hot-rolling process. In this case, preferably, the area fraction of the deformed ferrite may be 5% to 20%.

If the area fraction of the deformed ferrite is less than 5%, it may be difficult to obtain an intended temperature at the exit of the finish hot-rolling process and a sufficient degree of workability. On the other hand, if the area fraction of the deformed ferrite is greater than 20%, the burden of hot-rolling may increase, and thus the finish hot-rolling process may not be easily performed.

In addition, so as to impart workability to the hot-rolled steel sheet to a degree equal or similar to the degree of workability of existing cold-rolled steel sheets, the formation of the above-described texture, that is, γ-fiber texture/α-fiber texture, may be facilitated to obtain a high average plastic strain ratio (r-bar value) and a low plastic anisotropy (Δ-r value). In this case, the hot-rolled steel sheet may be uniformly deformed during a forming process, and thus products may be easily manufactured using the hot-rolled steel sheet.

In the exemplary embodiment of the present disclosure, the hot-rolling process may be performed by a lubricating rolling method so as to obtain an intended degree of drawability. In this case, it may be preferable that the coefficient of friction between the steel sheet and rolling rolls be 0.05 to 0.20.

If the coefficient of friction between the steel sheet and the rolling rolls is less than 0.05, rolling may not be properly performed because of slippage, and thus the surface properties of the steel sheet may deteriorate. On the other hand, if the coefficient of friction between the steel sheet and the rolling rolls is greater than 0.20, fatigue characteristics of the rolling rolls may deteriorate, and the lifespan of the rolling rolls may decrease. In addition, shear bands may be formed on the surface of the steel sheet, and thus the workability of the steel sheet may deteriorate. In other words, if the coefficient of friction is greater than 0.20, α-fiber shear texture having a (112)<110) component may be formed on the steel sheet, and thus after the hot-rolling process, γ-fiber texture improving workability may be poorly formed. Therefore, an intended degree of drawability may not be obtained.

According to the exemplary embodiment of the present disclosure, in addition to adjusting the coefficient of friction between the steel sheet and the rolling rolls, the depressing force of the rolling rolls may be controlled according to rolling steps of the hot-rolling process so as to improve the drawability of the steel sheet. The distribution of depressing force in the hot-rolling process has a close relationship with the productivity of the hot-rolling process and the fractions of phases of the steel sheet that affect the recovery characteristics and recrystallization behavior of the steel sheet.

In detail, preferably, the ratio of Rf/Rt may be adjusted to be within the range of 0.2 to 0.3 where Rt refers to the total reduction ratio of all stands, and Rf refers to the reduction ratio of last two passes.

If the Rf/Rt ratio is greater than 0.3, the burden of rear rolling rolls may increase, making it difficult to obtain an intended thickness of the hot-rolled steel sheet and causing a high thickness deviation, and if the Rf/Rt ratio is less than 0.2, driving force for recrystallization decreases, making it difficult to form intended texture and guarantee drawability.

If the finish hot-rolling process is performed under the above-described hot-rolling conditions, the hot-rolled steel sheet may have an average plastic strain ratio (r-bar value) of 1.3 or greater and a plastic anisotropy (Δr value) of 0.15 or less which hot-rolled steel sheets of the related art cannot have.

Cooling Process

After the hot-rolling process, a cooling process may additionally be performed to precipitate solute elements from the hot-rolled steel sheet. In the exemplary embodiment of the present disclosure, the cooling process may preferably be performed using a run-out-table (ROT) at a cooling rate of 80° C./s to 150° C./s to properly adjust the amounts of solute elements and obtain intended properties. If the cooling rate is less than 80° C./s, the amounts of solute elements in the steel sheet may not be optimally adjusted, and thus it may be difficult to obtain intended anti-aging properties and workability. On the other hand, if the cooling rate is greater than 150° C./s, although solute elements may easily precipitate in a subsequent process, it may be difficult to control the shape of the steel sheet, and thus the steel sheet may not be easily transferred.

Coiling Process

A coiling process may be performed after the hot-rolling process or the cooling process. According to the exemplary embodiment of the present disclosure, while the coiling process is performed on the hot-rolled steel sheet, recrystallization of deformed ferrite and texture formed during the hot-rolling process are rearranged. Therefore, if the coiling process is optimally performed, intended anti-aging properties and drawability may be obtained.

Preferably, the coiling process may be performed within the temperature range of 550° C. to 650° C.

If the process temperature of the coiling process is lower than 550° C., solute nitrogen (N) of the hot-rolled steel sheet may insufficiently precipitate, and thus the anti-aging properties of the hot-rolled steel sheet may be degraded, and the drawability of the hot-rolled steel sheet may be degraded because some grains of the hot-rolled steel sheet may not be recrystallized. On the other hand, if the process temperature of the coiling process is higher than 650° C., although recrystallization and softening properly occur, grains may grow abnormally, resulting in defects such as a defective surface shaped like orange peel, thereby degrading drawability.

After the coiling process, the hot-rolled steel sheet of the exemplary embodiment may include ferrite having a recrystallization percentage of 90% or greater. In addition, the hot-rolled steel sheet may include a small amount of precipitated cementite. Preferably, the fraction of cementite may be 0.1% to 0.8%. If the recrystallization percentage of ferrite is less than 90%, the workability of the hot-rolled steel sheet may be significantly decreased because of a high density of dislocations, and thus cracks may be formed during a drawing process.

Descaling Process

In general, a descaling process is performed on a hot-rolled steel sheet to remove scale. In the exemplary embodiment of the present disclosure, a descaling process is performed to remove an oxide layer from the surface of the hot-rolled steel sheet and impart proper compressive stress to the surface of the hot-rolled steel sheet. The proper compressive stress may promote the formation of ferrite grains having a high density of dislocations, particularly, mobile dislocations, thereby decreasing fixation of dislocations caused by solute elements and improving the anti-aging properties of the hot-rolled steel sheet.

To this end, the descaling process may be performed by a mechanical descaling method such as a shot blasting method.

For example, shot blasting may be performed using shot balls preferably having a diameter of 0.05 mm to 0.15 mm. If the diameter of shot balls is 0.05 mm or less, a surface layer of the hot-rolled steel sheet may be insufficiently removed by mechanical peeling, and an intended amount of residual stress may not be generated in the hot-rolled steel sheet. On the other hand, if the diameter of shot balls is greater than 0.15 mm, the maximum roughness value of the hot-rolled steel sheet may be significantly increased, and thus cracks may be formed in a forming process.

In addition, it may be preferable that the speed of shot blasting be within the range of 25 m/s to 65 m/s. If the speed of shot blasting is lower than 25 m/s, insufficient impactive force may be applied to the surface layer of the hot-rolled steel sheet by shot balls, and thus intended anti-aging properties and drawability may not be obtained. On the other hand, if the speed of shot blasting is higher than 65 m/s, the depth of a hardened surface layer may be 10% or more of the thickness of the hot-rolled steel sheet, and thus the hot-rolled steel sheet may be non-uniformly deformed in a forming process.

MODE FOR INVENTION

Hereinafter, the present disclosure will be described more specifically according to examples. However, the following examples should be considered in a descriptive sense only and not for purpose of limitation. The scope of the present invention is defined by the appended claims, and modifications and variations reasonably made therefrom.

EXAMPLE 1

Steel slabs having the compositions illustrated in Table 1 were prepared and subjected to a reheating process, a hot-rolling process, a coiling process, and a descaling process under the process conditions illustrated in Table 2, so as to manufacture hot-rolled steel sheets.

Thereafter, the tensile strength, plastic strain ratio, plastic anisotropy, drawability, stretchability, and anti-aging properties of each hot-rolled steel sheet were measured as illustrated in Table 3.

TABLE 1

| Steel | kinds | Chemical composition (wt %) C | Mn | Si | S | s.Al | P | N | B | (Al*B)/N |
|---|---|---|---|---|---|---|---|---|---|---|
| IS | A1 | 0.0011 | 0.56 | 0.009 | 0.012 | 0.061 | 0.046 | 0.0018 | 0.0015 | 0.051 |
| | A2 | 0.0018 | 0.68 | 0.015 | 0.006 | 0.044 | 0.037 | 0.0011 | 0.0009 | 0.036 |
| | A3 | 0.0015 | 0.46 | 0.011 | 0.008 | 0.055 | 0.041 | 0.0015 | 0.0018 | 0.066 |
| CS | A4 | 0.0021 | 0.14 | 0.011 | 0.015 | 0.014 | 0.012 | 0.0037 | 0.0002 | 0.0008 |
| | A5 | 0.0061 | 0.55 | 0.020 | 0.008 | 0.051 | 0.044 | 0.0019 | — | 0.000 |
| | A6 | 0.0015 | 0.46 | 0.011 | 0.010 | 0.041 | 0.039 | 0.0081 | 0.0010 | 0.0005 |
| | A7 | 0.0014 | 1.25 | 0.691 | 0.015 | 0.010 | 0.036 | 0.0015 | 0.0036 | 0.024 |
| | A8 | 0.0310 | 0.48 | 0.012 | 0.009 | 0.143 | 0.071 | 0.0012 | 0.0010 | 0.119 |

IS: inventive steel,
CS: comparative steel

TABLE 2

| No | Steels | RT (° C.) | CF | FHRT (° C.) | CT (° C.) | CR (° C./s) | RR (Rf/Rt) | SBD (mm) | SBS (m/s) |
|---|---|---|---|---|---|---|---|---|---|
| IS1-1 | A1 | 1140 | 0.14 | 700 | 600 | 100 | 0.26 | 0.12 | 52 |
| IS1-2 | A1 | 1150 | 0.14 | 740 | 600 | 100 | 0.21 | 0.11 | 57 |
| IS1-3 | A2 | 1140 | 0.10 | 720 | 620 | 110 | 0.25 | 0.10 | 46 |
| IS1-4 | A2 | 1140 | 0.10 | 740 | 620 | 110 | 0.25 | 0.08 | 60 |
| IS1-5 | A3 | 1150 | 0.16 | 680 | 580 | 120 | 0.22 | 0.12 | 55 |
| IS1-6 | A3 | 1180 | 0.16 | 680 | 580 | 120 | 0.26 | 0.08 | 51 |
| CS1-1 | A1 | 1150 | 0.35 | 740 | 600 | 90 | 0.24 | 0.08 | 50 |
| CS1-2 | A1 | 1150 | 0.14 | 910 | 600 | 100 | 0.21 | 0.08 | 50 |
| CS1-3 | A2 | 1140 | 0.10 | 740 | 450 | 110 | 0.28 | 0.12 | 58 |
| CS1-4 | A2 | 1160 | 0.10 | 760 | 620 | 50 | 0.24 | 0.11 | 50 |
| CS1-5 | A3 | 1140 | 0.16 | 740 | 580 | 90 | 0.13 | 0.12 | 90 |
| CS1-6 | A3 | 1180 | 0.16 | 760 | 580 | 90 | 0.22 | 0.00 | 0 |
| CS1-7 | A4 | 1150 | 0.12 | 760 | 600 | 90 | 0.25 | 0.08 | 48 |
| CS1-8 | A5 | 1150 | 0.16 | 750 | 600 | 90 | 0.24 | 0.12 | 56 |
| CS1-9 | A6 | 1140 | 0.16 | 760 | 580 | 90 | 0.22 | 0.10 | 56 |
| CS1-10 | A7 | 1150 | 0.16 | 760 | 600 | 90 | 0.28 | 0.10 | 58 |
| CS1-11 | A8 | 1150 | 0.16 | 910 | 600 | 90 | 0.21 | 0.12 | 48 |

IS: inventive sample,
CS: comparative sample,
RT: reheating temperature,
CF: coefficient of friction,
FHRT: finish hot-rolling temperature,
CT: coiling temperature,
CR: cooling rate,
RR: reduction ratio,
SBD: shot ball diameter,
SBS: shot blasting speed

TABLE 3

| No | DFF (%) | RFF (%) | SCC (ppm) | TS | PSR | PA | γ/α IR | D | S | AA |
|---|---|---|---|---|---|---|---|---|---|---|
| IS1-1 | 12 | 98 | 3 | ○ | ○ | ○ | 8.2 | ○ | ○ | ○ |
| IS1-2 | 10 | 96 | 3 | ○ | ○ | ○ | 6.9 | ○ | ○ | ○ |
| IS1-3 | 15 | 100 | 2 | ○ | ○ | ○ | 5.7 | ○ | ○ | ○ |
| IS1-4 | 16 | 99 | 3 | ○ | ○ | ○ | 7.4 | ○ | ○ | ○ |
| IS1-5 | 8 | 95 | 2 | ○ | ○ | ○ | 7.8 | ○ | ○ | ○ |
| IS1-6 | 11 | 97 | 2 | ○ | ○ | ○ | 9.5 | ○ | ○ | ○ |
| CS1-1 | 4 | 88 | 3 | ○ | X | X | 1.8 | X | X | ○ |
| CS1-2 | 0 | 100 | 4 | ○ | X | X | 1.1 | X | ○ | ○ |
| CS1-3 | 3 | 68 | 11 | Δ | X | X | 0.9 | X | X | X |
| CS1-4 | 9 | 75 | 9 | ○ | X | X | 1.5 | X | X | X |
| CS1-5 | 3 | 92 | 4 | ○ | X | X | 2.2 | X | ○ | ○ |
| CS1-6 | 10 | 92 | 7 | ○ | ○ | X | 4.9 | Δ | ○ | X |
| CS1-7 | 4 | 94 | 10 | X | X | X | 2.8 | X | ○ | X |
| CS1-8 | 3 | 81 | 18 | ○ | X | X | 1.4 | X | X | X |
| CS1-9 | 4 | 74 | 7 | ○ | X | X | 2.1 | X | X | X |

TABLE 3-continued

| No | DFF (%) | RFF (%) | SCC (ppm) | TS | PSR | PA | γ/α IR | D | S | AA |
|---|---|---|---|---|---|---|---|---|---|---|
| CS1-10 | 2 | 90 | 4 | ○ | ○ | X | 5.9 | Δ | X | ○ |
| CS1-11 | 0 | 99 | 27 | Δ | X | X | 1.1 | X | X | X |

TS: ○ 35 to 40 kgf/mm$^2$, Δ 40 Kgf/mm$^2$ or greater, X 35 kgf/mm$^2$ or less
PSR: ○ r-bar ≥ 1.3, X r-bar < 1.3
PA: ○ Δr = less than ±0.15, X Δr = ±0.15 or greater
D (when drawing ratio = 1.9): ○ good, Δ earing defect, X cracking
→ Drawing ratio = (Blank diameter)/(punch diameter)
S: ○ elongation ≥ 40%, X elongation < 40%
AA: ○ aging index = 2 kgf/mm$^2$ or less, X aging index = 2 kgf/mm$^2$ or greater
IS: inventive sample,
CS: comparative sample,
DFF: deformed ferrite fraction,
RFF: recrystallized ferrite fraction,
SCC: solute carbon content,
TS: tensile strength,
PSR: plastic strain ratio,
PA: plastic anisotropy,
γ/α IR: γ-fiber/α-fiber texture pole intensity ratio,
D: drawability,
S: stretchability,
AA: anti-aging properties As illustrated in Tables 1 to 3, the phase fractions, material properties, and texture pole intensity ratio of each of Inventive samples 1-1 to 1-6 satisfying conditions proposed in the present disclosure were within intended ranges. In addition, the anti-aging properties, stretchability, and drawability of each of Inventive samples 1-1 to 1-6 were satisfactory. That is, under the manufacturing conditions proposed by the present disclosure, solute elements in each inventive sample were properly controlled to suppress aging, and texture improving drawability was effectively formed to obtain an intended pole intensity ratio, phase fractions, and drawability.

Although Comparative Samples 1-1 to 1-6 were manufactured using steel slabs having compositions proposed in the present disclosure, manufacturing conditions for Comparative Samples 1-1 to 1-6 were not within the ranges proposed in the present disclosure. Therefore, high-strength steel sheets having anti-aging properties, high stretchability, and high drawability were not manufactured.

Although Comparative Samples 1-7 to 1-10 were manufactured under the manufacturing conditions proposed in the present disclosure, steel slabs used to form Comparative Samples 1-7 to 1-10 did not satisfy conditions proposed in the present disclosure. Therefore, high-strength hot-rolled steel sheets having anti-aging properties, high stretchability, and high drawability were not manufactured.

A steel slab and manufacturing conditions used for manufacturing Comparative Sample 1-11 did not satisfy conditions proposed in the present disclosure. Thus, all the anti-aging properties, stretchability, and drawability of Comparative samples 1-11 were not satisfactory.

EXAMPLE 2

Steel slabs having the compositions illustrated in Table 4 were prepared and subjected to a reheating process, a hot-rolling process, a coiling process, and a descaling process under the process conditions illustrated in Table 5, so as to manufacture hot-rolled steel sheets.

Thereafter, the microstructure fractions, plastic strain ratio, plastic anisotropy, drawability, stretchability, and anti-aging properties of each hot-rolled steel sheet were measured as illustrated in Table 6.

TABLE 4

| | Composition (wt %) | | | | | | | | (Al × | |
|---|---|---|---|---|---|---|---|---|---|---|
| Steels | C | Mn | Si | S | Al | P | N | B | B/N) | Note |
| B1 | 0.0007 | 0.16 | 0.009 | 0.012 | 0.051 | 0.008 | 0.0016 | 0.0011 | 0.0351 | IS |
| B2 | 0.0013 | 0.21 | 0.015 | 0.006 | 0.064 | 0.011 | 0.0011 | 0.0008 | 0.0465 | IS |
| B3 | 0.0011 | 0.09 | 0.011 | 0.008 | 0.045 | 0.009 | 0.0015 | 0.0017 | 0.0510 | IS |
| B4 | 0.0021 | 0.14 | 0.011 | 0.015 | 0.014 | 0.012 | 0.0037 | 0.0002 | 0.0008 | CS |
| B5 | 0.0061 | 0.25 | 0.020 | 0.008 | 0.051 | 0.014 | 0.0019 | — | — | CS |
| B6 | 0.0015 | 0.46 | 0.011 | 0.010 | 0.041 | 0.009 | 0.0061 | 0.0011 | 0.0074 | CS |
| B7 | 0.0014 | 1.25 | 0.691 | 0.015 | 0.010 | 0.036 | 0.0015 | 0.0032 | 0.0213 | CS |
| B8 | 0.0310 | 0.08 | 0.012 | 0.009 | 0.143 | 0.011 | 0.0012 | 0.0010 | 0.1192 | CS |

IS: inventive steel,
CS: comparative steel

TABLE 5

| | Reheating | Hot-rolling | | | Coiling | Descaling | | |
|---|---|---|---|---|---|---|---|---|
| No | Te (° C.) | CF | FRT (° C.) | RR (Rf/Rt) | Te (° C.) | SBD (mm) | BS (m/s) | Note |
| B1 | 1140 | 0.14 | 720 | 0.25 | 620 | 0.12 | 45 | IS2-1 |
| B1 | 1150 | 0.14 | 730 | 0.22 | 620 | 0.11 | 48 | IS2-2 |
| B2 | 1140 | 0.10 | 730 | 0.26 | 600 | 0.10 | 35 | IS2-3 |
| B2 | 1140 | 0.10 | 740 | 0.26 | 600 | 0.08 | 41 | IS2-4 |
| B3 | 1150 | 0.16 | 660 | 0.24 | 560 | 0.12 | 30 | IS2-5 |
| B3 | 1180 | 0.16 | 660 | 0.25 | 560 | 0.08 | 38 | IS2-6 |
| B1 | 1150 | 0.35 | 740 | 0.23 | 620 | 0.08 | 40 | CS2-1 |
| B1 | 1150 | 0.14 | 920 | 0.21 | 620 | 0.08 | 40 | CS2-2 |
| B2 | 1140 | 0.10 | 720 | 0.29 | 400 | 0.12 | 42 | CS2-3 |
| B2 | 1160 | 0.10 | 760 | 0.25 | 620 | 0.11 | 40 | CS2-4 |
| B3 | 1140 | 0.16 | 740 | 0.11 | 580 | 0.12 | 70 | CS2-5 |
| B3 | 1180 | 0.16 | 760 | 0.21 | 580 | — | — | CS2-6 |
| B4 | 1150 | 0.12 | 760 | 0.25 | 620 | 0.08 | 35 | CS2-7 |
| B5 | 1150 | 0.16 | 750 | 0.23 | 620 | 0.12 | 46 | CS2-8 |
| B6 | 1140 | 0.16 | 760 | 0.25 | 580 | 0.10 | 26 | CS2-9 |
| B7 | 1150 | 0.16 | 760 | 0.26 | 600 | 0.10 | 38 | CS2-10 |
| B8 | 1150 | 0.16 | 910 | 0.22 | 600 | 0.12 | 28 | CS2-11 |

Te: temperature,
CF: coefficient of friction,
FRT: finish rolling temperature,
RR: reduction ratio,
SBD: shot ball diameter,
BS: blasting speed,
IS: inventive sample,
CS: comparative sample

TABLE 6

| No | Microstructure fractions (%) DF | RF | r-bar | Δr | γ/α IR | Properties D | S | AA |
|---|---|---|---|---|---|---|---|---|
| IS2-1 | 10 | 95 | ○ | ○ | 9.6 | ○ | ○ | ○ |
| IS2-2 | 14 | 97 | ○ | ○ | 7.5 | ○ | ○ | ○ |
| IS2-3 | 12 | 99 | ○ | ○ | 6.8 | ○ | ○ | ○ |
| IS2-4 | 9 | 95 | ○ | ○ | 8.7 | ○ | ○ | ○ |
| IS2-5 | 15 | 98 | ○ | ○ | 10.4 | ○ | ○ | ○ |
| IS2-6 | 16 | 94 | ○ | ○ | 11.2 | ○ | ○ | ○ |
| CS2-1 | 3 | 86 | x | x | 2.1 | x | x | ○ |
| CS2-2 | 0 | 100 | x | x | 1.5 | x | ○ | ○ |
| CS2-3 | 4 | 65 | x | x | 1.1 | x | x | x |
| CS2-4 | 10 | 71 | x | x | 3.2 | x | x | x |
| CS2-5 | 2 | 91 | x | x | 1.9 | x | ○ | ○ |
| CS2-6 | 9 | 92 | ○ | x | 5.1 | Δ | ○ | x |
| CS2-7 | 3 | 93 | x | x | 3.1 | x | ○ | x |
| CS2-8 | 4 | 82 | x | x | 2.2 | x | x | x |
| CS2-9 | 4 | 71 | x | x | 2.6 | x | x | x |
| CS2-10 | 1 | 92 | ○ | x | 6.0 | Δ | x | ○ |
| CS2-11 | 0 | 100 | x | x | 1.2 | x | x | x |

Plastic strain ratio (r-bar): ○ if r-bar ≥ 1.3, x if r-bar < 1.3
Plastic anisotropy (Δr): ○ if Δr = less than ±0.15, x if Δr = ±0.15 or greater
Drawability (when drawing ratio = 1.9): ○ good, Δ earing defect, x cracking (drawing ratio = blank diameter/punch diameter)
Stretchability: ○ if elongation ≥ 40%, x if elongation < 40%
Anti-aging: ○ if aging index = 2 kgf/mm$^2$ or less, x if aging index = 2 kgf/mm$^2$ or greater
DF: deformed ferrite,
RF: recrystallized ferrite,
γ/α IR: γ-fiber/α-fiber texture pole intensity ratio,
D: drawability,
S: stretchability,
AA: anti-aging properties,
IS: inventive sample,
CS: comparative sample As illustrated in Tables 4 to 6, Inventive Samples 2-1 to 2-6 manufacturing using steel slabs under manufacturing conditions according to the present disclosure had microstructure fractions, material properties (plastic stain ratio and plastic anisotropy), and texture pole intensity ratios within the ranges proposed in the present disclosure. In addition, the anti-aging properties, stretchability, and drawability of Inventive Samples 2-1 to 2-6 were satisfactory.

That is, under the manufacturing conditions proposed by the present disclosure, strain aging of each inventive sample was suppressed, and texture improving drawability was effectively formed so as to obtain an intended pole intensity ratio, microstructure fractions, and drawability.

Although Comparative Samples 2-1 to 2-6 were manufactured using steel slabs having compositions proposed in the present disclosure, manufacturing conditions for Comparative Samples 2-1 to 2-6 were not within the ranges proposed in the present disclosure. Therefore, one or more of the anti-aging properties, stretchability, and drawability of Comparative Samples 1-1 to 1-6 were not satisfactory. That is, hot-rolled steel sheets having anti-aging properties and a high degree of workability were not manufactured.

Although Comparative Samples 2-7 to 2-10 were manufactured under the manufacturing conditions proposed in the present disclosure, steel slabs used to form Comparative Samples 2-7 to 2-10 did not have compositions proposed in the present disclosure. Therefore, one or more of the anti-aging properties, stretchability, and drawability of Comparative Samples 2-7 to 2-10 were not satisfactory. That is, hot-rolled steel sheets having anti-aging properties and a high degree of workability were not manufactured.

The composition of a steel slab and manufacturing conditions used for manufacturing Comparative Samples 2-11 did not satisfy conditions proposed in the present disclosure. Thus, all the anti-aging properties, stretchability, and drawability of Comparative samples 2-11 were not satisfactory.

The invention claimed is:

1. A hot-rolled steel sheet having a high degree of workability and anti-aging properties, the hot-rolled steel sheet comprising, by wt %, carbon (C): 0.0001% to 0.003%, manganese (Mn): 0.46% to 0.8%, silicon (Si): 0.03% or less (excluding 0%), aluminum (Al): 0.03% to 0.08%, boron (B): 0.0005% to 0.002%, nitrogen (N): 0.0005% to 0.002% phosphorus (P): 0.05% or less, sulfur (S): 0.001% to 0.015%, and the balance of iron (Fe) and inevitable impurities, wherein the hot-rolled steel sheet has a gamma (γ)-fiber/alpha (α)-fiber texture pole intensity ratio of 4 to 14.

2. The hot-rolled steel sheet of claim 1, wherein aluminum (Al), boron (B), and nitrogen (N) included in the hot-rolled steel sheet satisfy Formula 1 below:

$$0.025 \leq (Al \times B)/N \leq 0.07 \quad \text{[Formula 1]}$$

where Al, B, and N are in wt %.

3. The hot-rolled steel sheet of claim 1, wherein the hot-rolled steel sheet comprises solute carbon in an amount of 5 ppm or less.

4. The hot-rolled steel sheet of claim 1, wherein the hot-rolled steel sheet has an average plastic strain ratio (r-bar value) of 1.3 or greater and a plastic anisotropy (Δr value) of 0.15 or less.

5. The hot-rolled steel sheet of claim 1, wherein the hot-rolled steel sheet comprises ferrite in an area fraction of 90% or greater.

6. The hot-rolled steel sheet of claim 1, wherein the hot-rolled steel sheet has a thickness of 0.8 mm to 2.4 mm.

7. The hot-rolled steel sheet of claim 1, wherein the hot-rolled steel sheet has an elongation of 40% or greater.

* * * * *